US011616310B2

(12) United States Patent
Matsuura et al.

(10) Patent No.: US 11,616,310 B2
(45) Date of Patent: Mar. 28, 2023

(54) TERMINAL FITTING AND ELECTRIC WIRE WITH TERMINALS

(71) Applicant: Yazaki Corporation, Tokyo (JP)

(72) Inventors: Shinya Matsuura, Shizuoka (JP); Yoshitaka Itou, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/688,809

(22) Filed: Mar. 7, 2022

(65) Prior Publication Data

US 2022/0294129 A1 Sep. 15, 2022

(30) Foreign Application Priority Data

Mar. 12, 2021 (JP) ..... JP2021-040516

(51) Int. Cl.
*H01R 4/2495* (2018.01)
*H01R 4/2466* (2018.01)

(52) U.S. Cl.
CPC ..... *H01R 4/2495* (2013.01); *H01R 4/2466* (2013.01)

(58) Field of Classification Search
CPC ..... H01R 11/05; H01R 4/26; H01R 13/11; H01R 4/2425; H01R 4/2445; H01R 13/02; H01R 4/185; H01R 4/2466; H01R 4/2495
See application file for complete search history.

(56) References Cited

U.S. PATENT DOCUMENTS

| | | | | |
|---|---|---|---|---|
| 6,296,512 | B1 | 10/2001 | Akeda | |
| 2002/0013091 | A1* | 1/2002 | Fujimoto | H01R 4/2466 439/625 |
| 2002/0153158 | A1* | 10/2002 | Saito | H01R 4/2406 174/84 C |
| 2003/0054684 | A1* | 3/2003 | Yamanashi | H01R 4/2466 439/397 |

FOREIGN PATENT DOCUMENTS

| | | | |
|---|---|---|---|
| JP | 2002-270253 | A | 9/2002 |
| JP | 2003-243060 | A | 8/2003 |
| JP | 2003-249280 | A | 9/2003 |
| JP | 2003-257511 | A | 9/2003 |
| JP | 2003-264012 | A | 9/2003 |
| JP | 2003-317819 | A | 11/2003 |
| JP | 2004-253198 | A | 9/2004 |

* cited by examiner

*Primary Examiner* — Jean F Duverne
(74) *Attorney, Agent, or Firm* — Kenealy Vaidya LLP

(57) ABSTRACT

A core wire connecting body to be connected to a core wire in an electric wire includes: a bottom, a pair of cantilevered side walls that are disposed facing each other with a space therebetween; and a plurality of pairs of press contact bodies that are disposed facing each other with a space between the pair of side walls, and that cut the coating of the electric wire inserted from an opening, and make press contact with the strands. For the pairs of press contact bodies, compared to a distance between the press contact bodies that is a pair at the farthest section that is farthest from an end part of the electric wire, a distance between the press contact bodies that is a pair closer to the end part of the electric wire than the pair at the farthest section are, is smaller.

9 Claims, 4 Drawing Sheets

TERMINAL FITTING AND ELECTRIC WIRE WITH TERMINALS

CROSS-REFERENCE TO RELATED APPLICATION(S)

The present application claims priority to and incorporates by reference the entire contents of Japanese Patent Application No. 2021-040516 filed in Japan on Mar. 12, 2021.

BACKGROUND OF THE INVENTION

1. Field of the Invention

The present invention relates to a terminal fitting and an electric wire with terminals.

2. Description of the Related Art

Conventionally, as a terminal fitting, so-called a piercing terminal has been known that is to be physically and electrically connected to an electric wire in which a core wire including a plurality of strands is covered with a coating. In the piercing terminal, a core wire connecting body has a piercing part that breaks through the coating of the electric wire and pierces between the strands of the core wire. This type of terminal fitting is disclosed in Japanese Patent Application Laid-open No. 2002-270253, Japanese Patent Application Laid-open No. 2003-243060, Japanese Patent Application Laid-open No. 2003-249280, Japanese Patent Application Laid-open No. 2003-257511, Japanese Patent Application Laid-open No. 2003-264012, Japanese Patent Application Laid-open No. 2003-317819, and Japanese Patent Application Laid-open No. 2004-253198, for example.

In the conventional terminal fitting, as the number of strands included in the core wire increases, the number of strands that cannot contact the piecing part may increase. This may cause an increase in electrical resistance between the core wire and the conventional terminal fitting. Thus, the conventional terminal fittings have room for improvement in improving the electrical connection stability with the core wire.

SUMMARY OF THE INVENTION

It is an object of the present invention to provide a terminal fitting and an electric wire with terminals that can improve the stability of electrical connection with a core wire.

In order to achieve the above mentioned object, a terminal fitting according to one aspect of the present invention includes a core wire connecting body that is to be physically and electrically connected to a core wire of an electric wire in which the core wire including a plurality of strands is covered with a coating, wherein the core wire connecting body includes: a bottom; a pair of cantilevered side walls that stand up from the bottom and are disposed facing each other with a space therebetween; and a plurality of pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section make press contact with the strands of an outermost layer of the core wire, and the pair of press contact bodies that are closer to the end part of the electric wire than the pair of press contact bodies at the farthest section are, cut at least the strands of the outermost layer among the strands, and make press contact with the strands on an inner side of the strands of the outermost layer.

In order to achieve the above mentioned object, a terminal fitting according to another aspect of the present invention includes a core wire connecting body that is to be physically and electrically connected to a core wire of an electric wire in which the core wire including a plurality of strands is covered with a coating, wherein the core wire connecting body includes: a bottom; a pair of cantilevered side walls that stand up from the bottom and are disposed facing each other with a space therebetween; and at least two pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the at least two pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section cut part of at least the strands of an outermost layer of the core wire and make press contact with the strands on an inner side of the cut strands, the pairs of press contact bodies on the end part side of the electric wire with respect to the pair of press contact bodies at the farthest section make press contact with the strands on the inner side of the strands with which the pair of press contact body at the farthest section make press contact, cut the strands on an outer side of the strands to be subjected to press contact, and make press contact with the strands that are on the more inner side when a distance between the pair of the press contact bodies is smaller.

In order to achieve the above mentioned object, an electric wire with terminals according to still another aspect of the present invention includes an electric wire in which a core wire including a plurality of strands is covered with a coating; and a terminal fitting that is assembled to the electric wire, wherein the terminal fitting includes a core wire connecting body that is to be physically and electrically connected to the core wire, the core wire connecting body includes: a bottom; a pair of cantilevered side walls that stand up from the bottom and are disposed facing each other with a space therebetween; and a plurality of pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section make press contact with the strands of the outermost layer of the core wire, and the pair of press contact bodies that are closer to the end part of the electric wire than the pair of press contact bodies at the farthest section are, cut at least the strands of an outermost layer among the strands, and make press contact with the strands on an inner side of the strands of the outermost layer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes in detail a terminal fitting and an electric wire with terminals according to the present invention with reference to the drawings. The present invention is not limited by this embodiment.

Embodiment

An embodiment of the terminal fitting and the electric wire with terminals according to the present invention will be described based on FIG. 1 to 5.

Symbol 1 in FIG. 1 to 5 denotes the electric wire with terminals of the present embodiment. This electric wire with terminals 1 includes an electric wire 10 and a terminal fitting 20 that is assembled to the electric wire 10, and these components are physically and electrically connected to each other.

This electric wire with terminals 1 has a configuration in which the terminal fitting 20 is connected to at least one of the two terminals of the electric wire 10. This electric wire with terminals 1 may have a configuration in which a single piece of the electric wire 10 is connected to a terminal fitting 20, or may have a configuration in which a plurality of the electric wires 10 are connected by at least one terminal fitting 20 and the electric wires 10 are electrically connected via the terminal fitting 20. For example, the terminal fitting 20 is formed as a terminal fitting that is physically and electrically connected to a mate terminal fitting by fitting connection thereto, or as a terminal fitting that is physically and electrically connected to an electric connection part of the mate terminal fitting by screw fixation with the electrical connection part of the mate terminal fitting. For example, the terminal fitting 20, when formed as a joint terminal that electrically connects a plurality of the electric wires 10, may be physically and electrically connected to the electric wires 10 and may allow itself to electrically connect all the electric wires 10; alternatively, the terminal fitting 20 may be a joint terminal that physically and electrically connects the electric wires 10, in which at least two electric wires 10 are combined as one set, and the joint terminal may be provided for each of a plurality of the sets of the electric wires 10. In the electric wire with terminals 1 indicated here, one terminal fitting 20 that is to be connected to a mate terminal fitting by fitting connection is connected to one terminal of the electric wire 10.

Figure 3:
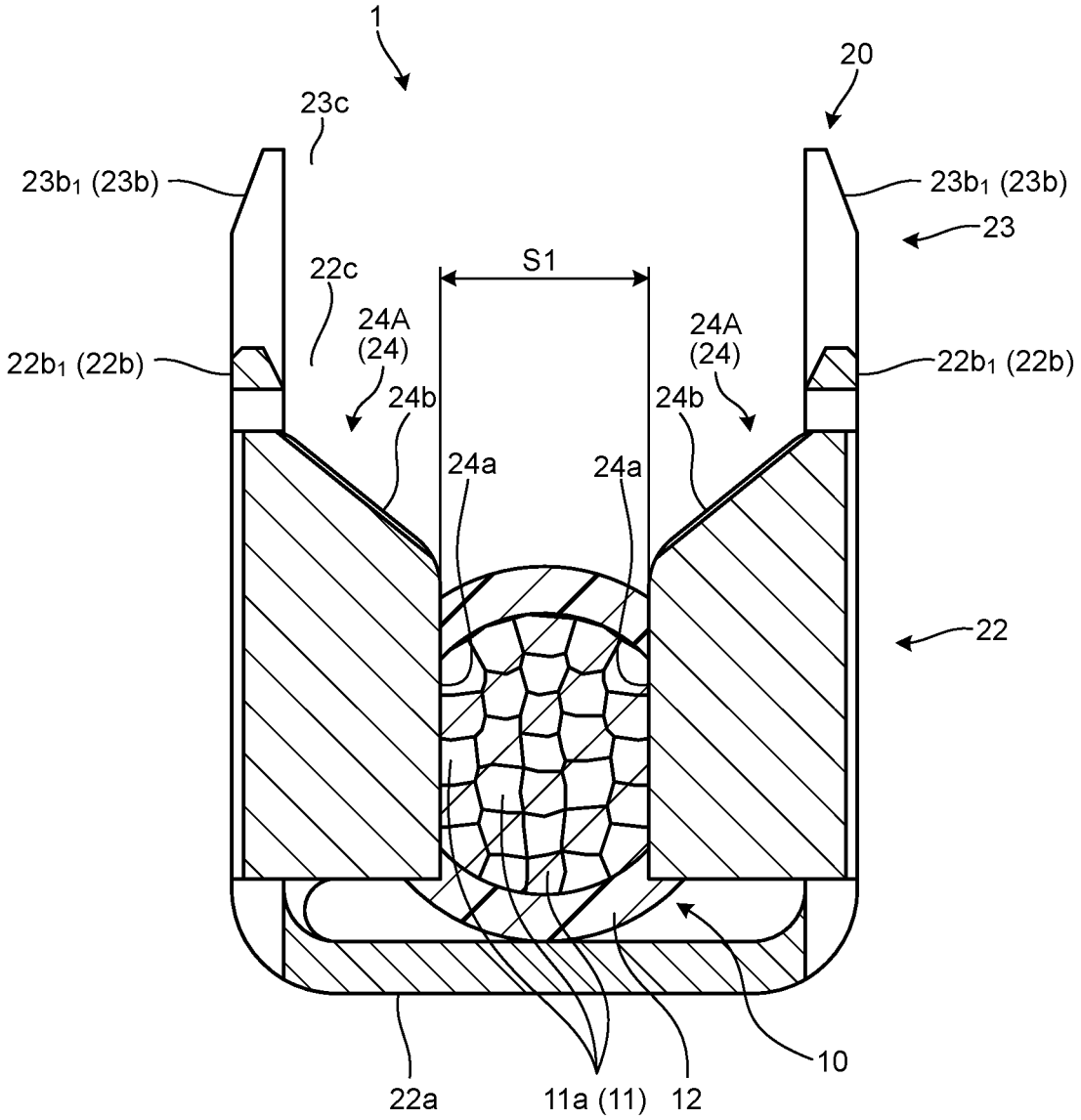
FIG. 3 is a schematic diagram of a section across line X1-X1 of FIG. 2.
Figure 4:
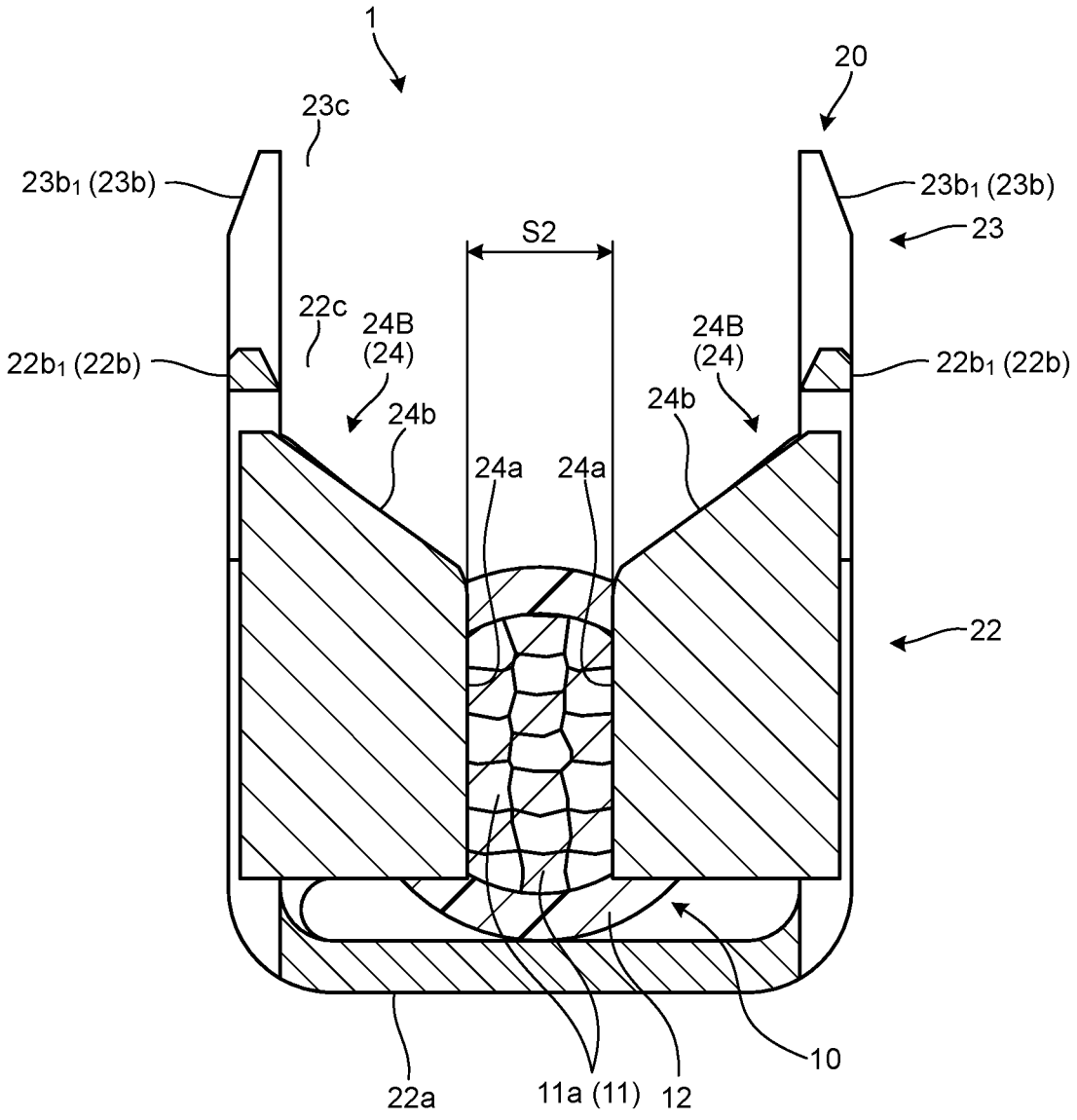
FIG. 4 is a schematic diagram of a section across line X2-X2 of FIG. 3.
Figure 5:
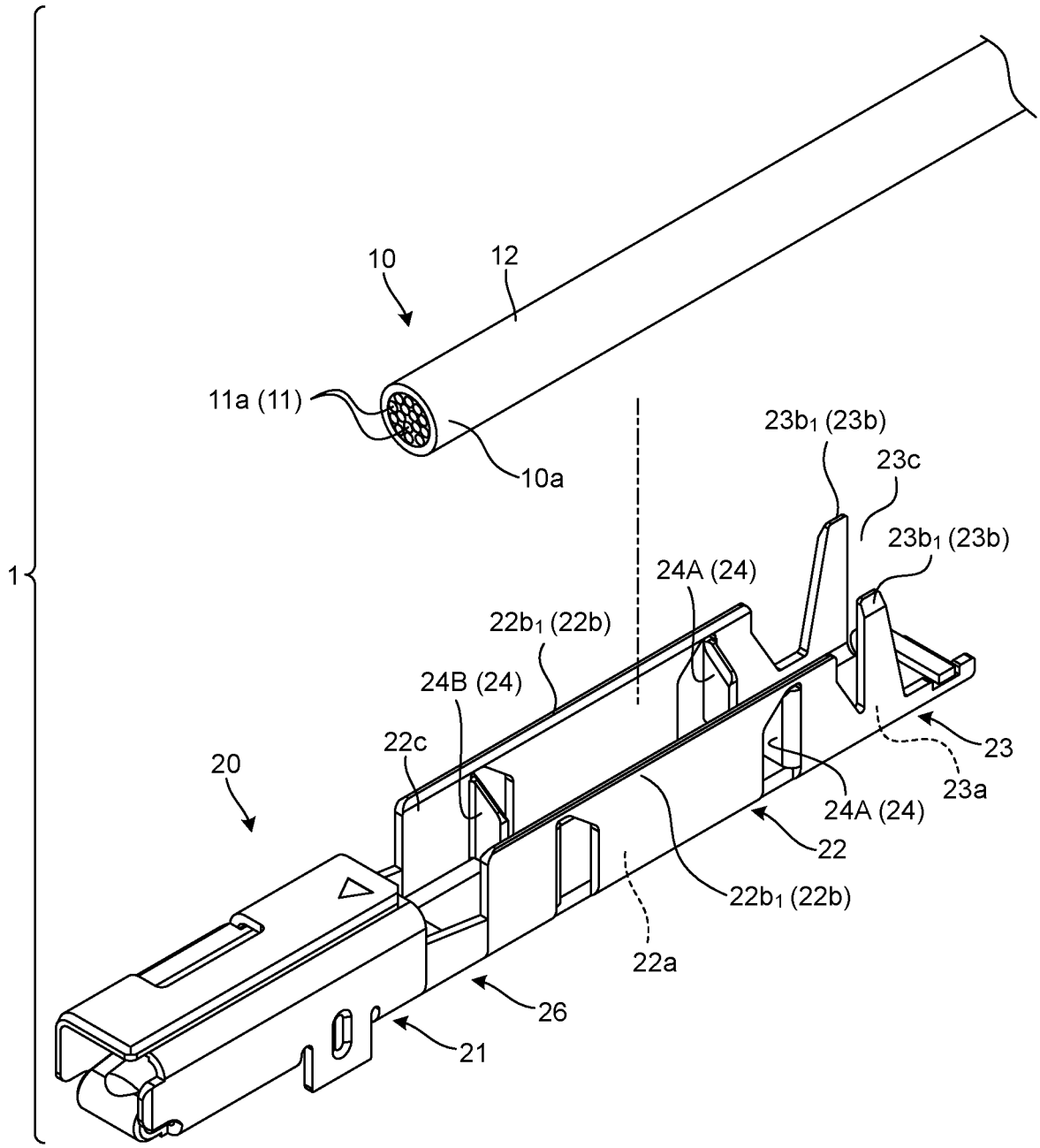
FIG. 5 is an exploded perspective view illustrating the terminal fitting and the electric wire with terminals of the embodiment.

The electric wire 10 includes a core wire 11 that includes a plurality of strands 11*a*, and a coating 12 that covers the core wire 11 (FIG. 3 to 5). The electric wire 10 indicated here includes the core wire 11 in which the strands 11*a* each made of a conductive metal member are bundled in a cylindrical shape, and the coating 12 of a cylindrical shape covering the core wire 11 concentrically from an outer surface side. The strands 11*a* are molded of aluminum, an aluminum alloy, copper or a copper alloy, for example.

The core wire 11 may be a core wire in which a plurality of the strands 11*a* with their axial directions being aligned with each other are bundled in a cylindrical shape, or may be a twisted wire in which the strands 11*a* bundled in a cylindrical shape are twisted together. Furthermore, the core wire 11 as the twisted wire may be a core wire made by twisting all of the strands 11*a* bundled together in a cylindrical shape, or may be a core wire in which one strand 11*a* is placed in the center and wrapped with the remaining other strands 11*a* therearound, or may be a core wire in which there are a plurality of strand groups each made by twisting the strands 11*a* together and the strand groups are bundled into a cylindrical shape and twisted together. Whatever form the core wire 11 takes as described in the foregoing, a plurality of the strands 11*a* are disposed in the outermost layer, and another plurality of the strands 11*a* are disposed on the inner side of the strands 11*a* of the outermost layer.

The terminal fitting 20 is molded of a conductive material such as metal. The terminal fitting 20 indicated here is formed by press mold using a metal plate as a base material. This terminal fitting 20 includes a terminal connecting body 21 that is physically and electrically connected to a terminal connecting body of a mate terminal fitting (not illustrated), a core wire connecting body 22 that is physically and electrically connected to the core wire 11 of the terminal of the electric wire 10, and a coating connecting body 23 that is physically connected to the coating 12 of the terminal of the electric wire 10 (FIGS. 1, 2, and 5).

For example, the terminal connecting body 21 of the terminal fitting 20 and the terminal connecting body of the mate terminal fitting are inserted and mated with each other, one of which is formed in a shape of a female terminal and the other of which is formed in a shape of a male terminal. In this example, the terminal connecting body 21 of the terminal fitting 20 is formed in the shape of a female terminal, and the terminal connecting body of the mate terminal fitting is formed in the shape of a male terminal.

Figure 1:
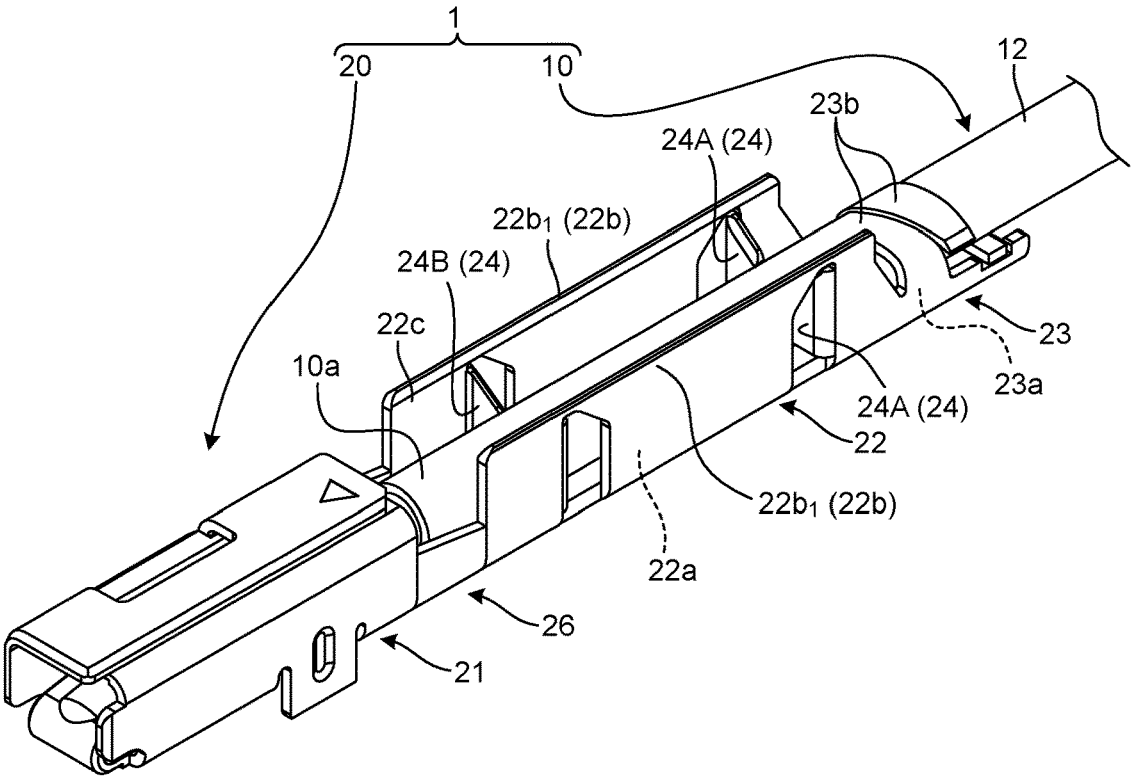
FIG. 1 is a perspective view illustrating a terminal fitting and an electric wire with terminals of an embodiment.
Figure 2:
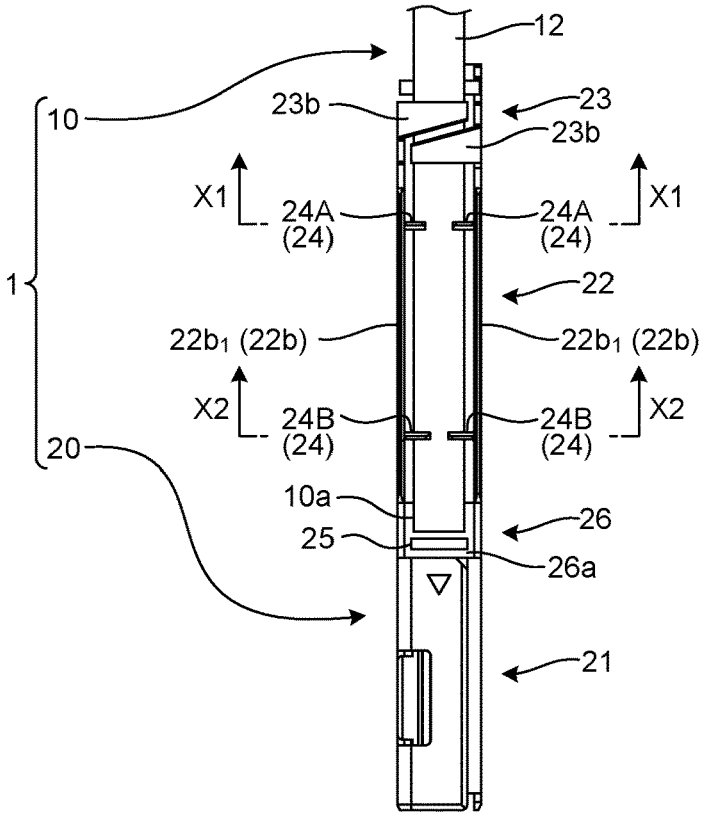
FIG. 2 is a plan view illustrating the terminal fitting and the electric wire with terminals of the embodiment viewed from an opening side.

The core wire connecting body 22 has a bottom 22*a*, and a pair of cantilevered side walls 22*b*, 22*b* that stand up from the bottom 22*a* and are disposed facing each other with a space therebetween (FIG. 1 and FIG. 3 to 5). The terminal of the electric wire 10 is housed in a space enclosed by the bottom 22*a* and the pair of side walls 22*b*, 22*b*. In the core wire connecting body 22 indicated here, the pair of side walls 22*b*, 22*b* of a rectangular shape are hung from both ends of the bottom 22*a* of a rectangular shape. In this core wire connecting body 22, in the space enclosed by the bottom 22*a* and the pair of side walls 22*b*, 22*b*, the terminal of the electric wire 10 is inserted from an opening 22*c* between respective free ends $\mathbf{22}b_1$, $\mathbf{22}b_1$ of the pair of side walls 22*b*, 22*b* (FIG. 1 and FIG. 3 to 5). In the terminal fitting 20 indicated here, an end part 10*a* of the electric wire 10 protrudes from the core wire connecting body 22 to the terminal connecting body 21 side, and the electric wire 10 is drawn out from the core wire connecting body 22 on the opposite side of the terminal connecting body 21 side (FIGS. 1 and 2).

This core wire connecting body 22 further includes a plurality of pairs of press contact bodies 24, 24 that are disposed facing each other with a space between the pair of side walls 22*b*, 22*b* and cut the coating 12 of the electric wire 10 inserted from the opening 22*c* to make press contact with the strands 11*a* of the core wire 11 (FIG. 1 to 5).

Each pair of press contact bodies 24, 24 may include press contact bodies each protruding from the bottom 22*a* to the opening 22*c*, or may include a press contact body protruding from one side wall 22*b* to the other side wall 22*b*, and a press contact body protruding from the other side wall 22*b* to the one side wall 22*b*. The press contact bodies 24 indicated here are each formed as a piece that is a part of the side wall 22*b*, which is bent 90 degrees from the side wall 22*b*.

Each pair of press contact bodies 24, 24 have press contact ends 24*a*, 24*a* between which the electric wire 10 is press-fitted, the press contact ends 24*a*, 24*a* being disposed facing each other with a space therebetween in the direction in which the pair of side walls 22*b*, 22*b* are facing each other (FIGS. 3 and 4). This pair of press contact bodies 24, 24 sandwich the core wire 11 with their respective press contact ends 24*a*, 24*a*, and apply pressuring force to the strands 11*a* of the core wire 11 from the press contact ends 24*a*, 24*a*, to physically and electrically connect the press contact ends 24*a*, 24 to the strands 11*a*. For this reason, a distance between the respective press contact ends 24*a*, 24*a* of the pair of press contact bodies 24, 24 is smaller than a diameter of the core wire 11. Each of the press contact ends 24*a* may be a press contact end that is formed as a plane along a direction of insertion of the electric wire 10 from the opening 22*c*, or as a press contact blade of a blade shape. The press contact end 24*a* indicated here is formed as a plane with a thickness equal to the thickness of the base material.

This pair of press contact bodies 24, 24 have a core wire introduction section at the end on the opening 22*c* side, the core wire introduction section being an insertion start point when the electric wire 10 is press-fitted between the press contact ends 24*a*, 24*a*, and having a gap larger than the distance between the press contact ends 24*a*, 24*a*. For example, the pair of press contact bodies 24, 24 have, at the ends on the opening 22*c* side, inclined portions 24*b*, 24*b* that are connected to the respective press contact ends 24*a*, 24*a* and that a distance between the inclined portions 24*b*, 24*b* increases from the boundary with the press contact ends 24*a*, 24*a* toward the opening 22*c* side (FIGS. 3 and 4). The core wire introduction section is formed by the inclined portions 24*b*, 24*b*. Each of the inclined portions 24*b* may be formed as a plane with a thickness equal to the thickness of the base material, or as a press contact blade of a blade shape. The inclined portion 24*b* indicated here is formed as a press contact blade.

The plurality of pairs of press contact bodies 24, 24 formed in this way are disposed so as to be spaced from each other in an axial direction of the electric wire 10 assembled into the core wire connecting body 22.

The electric wire 10 is inserted from the opening 22*c* into the space enclosed by the bottom 22*a* and the pair of side walls 22*b*, 22*b*. With this process, the pairs of press contact bodies 24, 24 cut the coating 12 of the electric wire 10, which has been pushed in the space, with their respective inclined portions 24*b*, 24*b*, thereby exposing the core wire 11 on the inner side of the coating 12. As the electric wire 10 is further pushed in deeply, the core wire 11 that is exposed is press-fitted in between the press contact ends 24*a*, 24*a*, and the core wire 11 makes press contact with each of the press contact ends 24*a*, 24*a*. As a result, this electric wire 10 allows the press contact ends 24*a*, 24*a* to physically and electrically connect the core wire 11 to the terminal fitting 20.

As in the foregoing, the core wire 11 includes a plurality of the strands 11*a* disposed in the outermost layer and a plurality of the strands 11*a* disposed on the inner side of the strands 11*a* in the outermost layer. Thus, in order to improve the stability of the electrical connection with this core wire 11, it is desirable that the core wire connecting body 22 contact the strands 11*a* in the outermost layer and the strands 11*a* on the inner side of the strands 11*a* of the outermost layer to increase the number of strands 11*a* in a contact state, so as to suppress the increase in the electrical resistance between the core wire connecting body 22 and the core wire 11.

Then, for the pairs of press contact bodies 24, 24, compared to a distance S1 between the press contact bodies that is a pair at the farthest section that are farthest from the end part 10*a* of the electric wire 10, a distance S2 between the press contact bodies that is a pair closer to the end part 10*a* of the electric wire 10 than the pair at the farthest section is, is smaller (FIGS. 3 and 4). The pair of press contact bodies 24, 24 at the farthest section make press contact with the strands 11*a* of the outermost layer of the core wire 11. On the other hand, the pair of press contact bodies (hereinafter referred to as "the pair of press contact bodies 24, 24 on the end part 10*a* side") that are closer to the end part 10*a* of the electric wire 10 than the pair of press contact bodies 24, 24 at the farthest section are cut at least the strands 11*a* of the outermost layer among the plurality of the strands 11*a* in the core wire 11, and make press contact with the strands 11*a* on the inner side of the strands 11*a* of the outermost layer.

As a result, the pair of press contact bodies 24, 24 at the farthest section cut the coating 12 of the electric wire 10, which has been pushed in, with their respective inclined portions 24*b*, 24*b*, thereby exposing the strands 11*a* of the outermost layer in the core wire 11 in the coating 12. At this pair of press contact bodies 24, 24 at the farthest section, when the electric wire 10 is further pushed in deeply, the exposed strands 11*a* of the outermost layer of the core wire 11 are press-fitted in between the respective press contact ends 24*a*, 24*a* while being scratched along the respective press contact ends 24*a*, 24*a*. As a result, the pair of press contact bodies 24, 24 at the farthest section allow their respective press contact ends 24*a*, 24*a* to make press contact with the strands 11*a* of the outermost layer.

In contrast, the pair of press contact bodies 24, 24 on the end part 10*a* side cut at least the coating 12 of the electric wire 10 that has been pushed in by their respective inclined portions 24*b*, 24*b*, thereby exposing at least the strands 11*a* of the outermost layer in the core wire 11 on the inner side of the coating 12. In doing so, the pair of press contact bodies 24, 24 on the end part 10*a* side may cut in the strands 11*a* of the outermost layer of the core wire 11 by their respective inclined portions 24*b*, 24*b*. The pair of press contact bodies 24, 24 on the end part 10*a* side may cut at least the strands 11*a* of the outermost layer among the plurality of the strands 11*a* in the core wire 11 with the respective inclined portions 24*b*, 24*b*, and expose the strands 11*a* on the inner side of the strands 11*a* of the outermost layer along with the strands 11*a* of the outermost layer.

The electric wire 10 is further pushed in and press-fitted in between the press contact ends 24*a*, 24*a*. With this process, if there are strands 11*a* of the outermost layer that touch the press contact ends 24*a*, 24*a* of the pair of press contact bodies 24, 24 on the end part 10*a* side without being cut by the inclined portions 24*b*, 24*b*, at least the above-described strands 11*a* of the outermost layer among the plurality of the strands 11*a* in the core wire 11 are cut with the press contact ends 24*a*, 24*a*. At the pair of press contact bodies 24, 24 on the end part 10*a* side, the strands 11*a* on the inner side of the strands 11*a* of the outermost layer of the core wire 11, which are exposed when the strands 11*a* of the outermost layer are cut, are press-fitted in between the press contact ends 24*a*, 24*a* while being scratched along the press contact ends 24*a*, 24*a*. Thus, the pair of press contact bodies 24, 24 on the end part 10*a* side allow their respective press contact ends 24*a*, 24*a* to make press contact with the strands 11*a* on the inner side of the strands 11*a* of the outermost layer. If there are strands 11*a* that have been cut with the inclined portions 24*b*, 24*b* of the pair of press contact bodies 24, 24 on the end part 10*a* side, the strands 11*a* on the inner side of the strands 11*a* that have been cut are exposed, and the exposed strands 11*a* are press-fitted in between the press contact ends 24*a* and 24*a* while being scratched along the press contact ends 24*a* and 24*a*. Thus, the pair of press contact bodies 24, 24 on the end part 10*a* side allow their respective press contact ends 24*a*, 24*a* to make press contact with the strands 11*a* on the inner side of the strands 11*a* of the outermost layer. The pair of press contact bodies 24, 24 on the end part 10*a* side allow, depending on a distance between the respective press contact ends 24*a*, 24*a*, the press contact ends 24*a*, 24*a* to cut the strands 11*a* on the inner side of the strands 11*a* that have been cut by the respective inclined portions 24*b*, 24*b*. The pair of press contact bodies 24, 24 on the end part 10*a* side allow the strands 11*a*, which are exposed when the above-described strands 11*a* are cut, to be press-fitted in between the press contact ends 24*a*, 24*a* while being scratched along the press contact ends 24*a*, 24*a*. Thus, the pair of press contact bodies 24, 24 on the end part 10*a* side allow their respective press contact ends 24*a*, 24*a* to make press contact with the strands 11*a* on the inner side of the strands 11*a* of the outermost layer.

In this way, the core wire connecting body 22 allows the pair of press contact bodies 24,24 at the farthest section to make press contact with the strands 11*a* of the outermost layer of the core wire 11. This core wire connecting body 22 then allows the pair of press contact bodies 24, 24 on the end part 10*a* side to make press contact with the strands 11*a* on the inner side of the strands 11*a* of the outermost layer of the core wire 11. Therefore, this terminal fitting 20 comes into contact with more strands 11*a* than the conventional terminal fittings do, and can increase a contact area with the core wire 11, thereby suppressing the increase in the electrical resistance with this core wire 11.

In the electric wire 10, when each of the strands 11*a* is molded of aluminum or an aluminum alloy, an oxide film is formed on a surface of the strand 11*a*. However, the pairs of press contact bodies 24, 24 scratch the surfaces of the strands 11*a* with their respective press contact ends 24*a*, 24*a* to scrape off the oxide films of the strands 11*a* while the electric wire 10 is being pushed in. Thus, the terminal fitting 20 allows the pair of press contact bodies 24, 24 at the farthest section to come into contact with the strands 11*a* of the outermost layer the core wire 11 without the oxide films interposed therebetween, and allows the pair of press contact bodies 24, 24 on the end part 10*a* side to come into contact with the strands 11*a* on the inner side of the strands 11*a* of the outermost layer of the core wire 11 without the oxide films interposed therebetween. Therefore, this terminal fitting 20, even when the strands 11*a* are molded of aluminum or an aluminum alloy, can suppress the increase in the electrical resistance with the core wire 11.

Specifically, among a plurality of pairs of the press contact bodies 24, 24, a pair of press contact bodies 24, 24 closer to the end part 10*a* of the electric wire 10 have a smaller distance between the press contact bodies such that the pair makes press contact with the strands 11*a* on the more inner side of the core wire 11. As a result, the core wire connecting body 22 allows the pair of press contact bodies 24, 24 at the farthest section to make press contact with the strands 11*a* of the outermost layer of the core wire 11, and allows the pair of press contact bodies 24, 24 on the end part 10*a* side to make press contact with the strands 11*a* on the inner side of the strands 11*a* of the outermost layer of the core wire 11.

For example, the core wire connecting body 22 having two pairs of press contact bodies 24, 24 allows the pair of press contact bodies 24, 24 at the farthest section to make press contact with the strands 11*a* of the outermost layer of the core wire 11, and allows the pair of press contact bodies 24, 24 on the end part 10*a* side to make press contact with the strands 11*a* on the inner side of the strands 11*a* of the outermost layer of the core wire 11.

When the core wire 11 is a twisted wire, there may be provided with the pair of press contact bodies 24, 24 at the farthest section, and on the end part 10*a* side of the electric wire 10 with respect to the press contact bodies 24, 24 at the farthest section, at least one pair of press contact bodies 24, 24 having the same shape and the same distance between the press contact bodies as the pair of press contact bodies 24, 24 at the farthest section does. A distance between adjacent pairs of press contact bodies 24, 24 for all pairs whose distances between the press contact bodies are the same is determined, considering a twisting pitch of the core wire 11, so that the press contact bodies of adjacent pairs do not contact the same combination of strands 11*a* of the outermost layer. As a result, this terminal fitting 20 increases the number of strands 11*a* of the outermost layer that are in a contact state compared to the previous example, and can further suppress the increase in the electrical resistance with the core wire 11. Furthermore, when the core wire 11 is a twisted wire, on the end part 10*a* side of the electric wire 10 with respect to all of the pairs of press contact bodies 24, 24 having the same distance between the press contact bodies, there may be provided with a plurality of pairs of press contact bodies 24, 24 having the same shape and the same distance between the press contact bodies, on the end part 10*a* side. A distance between the adjacent pairs of press contact bodies 24, 24 for all the pairs having the same distance between the press contact bodies on the end part 10*a* side is determined, considering a twisting pitch of the core wire 11, so that the press contact bodies of the adjacent pairs do not contact the same combination of strands 11*a* on the inner side of the strands 11*a* of the outermost layer. As a result, this terminal fitting 20 increases the number of strands 11*a* on the inner side of the strands 11*a* of the outermost layer that are in a contact state compared to the previous example, and can further suppress the increase in the electrical resistance with the core wire 11.

In the electric wire 10, there may be provided a core wire 11 in which a plurality of strands 11*a* are disposed in a plurality of layers on the inner side of the plurality of strands 11*a* of the outermost layer (that is, a core wire 11 including an outermost layer including a plurality of strands 11*a* and a plurality of inner layers each including a plurality of strands 11*a*). In this case, for example, there may be provided a pair of press contact bodies 24, 24 (pair of press contact bodies 24, 24 at the farthest section) to make press contact with the strands 11*a* of the outermost layer, and a pair of press contact bodies 24, 24 (pair of press contact bodies 24, 24 on the end part 10*a* side) to make press contact with the strands 11*a* of each of the inner layers. As a result, the core wire connecting body 22 allows a plurality of the pairs of press contact bodies 24, 24 to make press contact with the strands 11*a* of the respective layers in the core wire 11. Thus, even if this terminal fitting 20 is used to connect an electric wire 10 with a core wire 11 including three or more layers of strands 11*a*, this terminal fitting 20 comes into contact with more strands 11*a* than the conventional terminal fittings do, and the contact area with the core wire 11 can be increase, thereby suppressing the increase in the electrical resistance with this core wire 11.

The core wire connecting body 22 indicated here includes the two pairs of press contact bodies 24, 24. In other words, the core wire connecting body 22 indicated here includes a pair of first press contact bodies 24A, 24A, which is the pair of press contact bodies 24, 24 at the farthest section, and a pair of second press contact bodies 24B, 24B, which is the pair of press contact bodies 24, 24 on the end part 10*a* side (FIG. 1 to 5).

The pair of press contact bodies 24, 24 at the farthest section may be a pair of press contact bodies that partially notch a strand 11*a* of the outermost layer of the core wire 11 and make press contact with the strand 11*a* of the outermost layer in the notch. The notch is a portion created by the press contact body 24 cutting through part of the strand 11*a*, or a portion created by the press contact body 24 crushing part of the strand 11*a*.

The pair of press contact bodies 24, 24 at the farthest section may be a pair of press contact bodies that cut part of the strands 11*a* of the outermost layer of the core wire 11 and make press contact with the other strands 11*a* of the outermost layer.

The pair of press contact bodies 24, 24 at the farthest section may cut part of at least the strands 11*a* of the outermost layer of the core wire 11 and make press contact with the strands 11*a* on the inner side of the cut strands 11*a*. For example, the core wire connecting body 22 in this case includes at least two pairs of press contact bodies 24, 24. The pair of press contact bodies 24,24 at the farthest section of the at least two pairs cut part of the plurality of strands 11*a* of the outermost layer of the core wire 11 and make press contact with the strands 11*a* on the inner side of the cut strands 11*a*. The pair of press contact bodies 24, 24 on the end part 10*a* side with respect to the pair of press contact bodies 24, 24 at the farthest section make press contact with the strands 11*a* on the inner side of the strands 11*a* with which the pair of press contact bodies 24, 24 at the farthest section make press contact, and cut the strands 11*a* on the outer side of the strands 11*a* to be subjected to press contact and make press contact with the strands 11*a* on the inner side of the cut strands 11*a*. If there are a plurality of pairs of press contact bodies 24, 24 on the end part 10*a* side with respect to the pair of press contact bodies 24, 24 at the farthest section, each of the pairs of press contact bodies 24, 24 on the end part 10*a* side makes press contact with the strands 11*a* on the more inner side when a distance between the press contact bodies is smaller.

The core wire connecting body 22 thus allows the pair of press contact bodies 24, 24 at the farthest section to make press contact with the strands 11*a* on the inner side of the strands 11*a* of the outermost layer of the core wire 11. This core wire connecting body 22 then allows the pair of press contact bodies 24, 24 on the end part 10*a* side to make press contact with the strands 11*a* on the inner side of the above-described strands 11*a*. Therefore, this terminal fitting 20 comes into contact with more strands 11*a* than the conventional terminal fittings do, and can increase a contact area with the core wire 11, thereby suppressing the increase in the electrical resistance with this core wire 11.

In addition, even if the strands 11*a* are molded of aluminum or an aluminum alloy, the terminal fitting 20 allows the pair of press contact bodies 24, 24 at the farthest section to come into contact with the strands on the inner side of the strands 11*a* of the outermost layer of the core wire 11 without the oxide films interposed therebetween, and allows the pair of press contact bodies 24, 24 on the end part 10*a* side to come into contact with the strands 11*a* on the inner side of the strands 11*a* with which the pair of press contact bodies 24, 24 at the farthest section make press contact without the oxide films interposed therebetween. Therefore, this terminal fitting 20, even when the strands 11*a* are molded of aluminum or an aluminum alloy, can suppress the increase in the electrical resistance with the core wire 11.

Meanwhile, the terminal fitting 20 allows the pair of press contact bodies 24, 24 at the farthest section to cut at least the strands 11*a* of the outermost layer of the core wire 11. For this reason, this terminal fitting 20 is provided with a locking body 25 as described below to prevent the cut strands 11*a* from coming off from an end face of the end part 10*a* of the electric wire 10 (FIG. 2). This locking body 25 is formed as a locking body that is disposed facing the end face of the end part 10*a* of the electric wire 10, and is capable of locking the cut strands 11*a* while retaining them on the inner side of the coating 12. For example, the terminal fitting 20 indicated here includes a connecting body 26 that connects the terminal connecting body 21 to the core wire connecting body 22 (FIGS. 1, 2 and 5). Then, this terminal fitting 20 allows the end part 10*a* of the electric wire 10 to protrude to the position of this connecting body 26 (FIGS. 1 and 2). Then, in this terminal fitting 20, a piece protruding from a bottom 26*a* of the connecting body 26 is used as the locking body 25.

The coating connecting body 23 includes a bottom 23*a* and a pair of barrel pieces 23*b*, 23*b* protruding from both ends of the bottom 23*a* (FIGS. 1, 2 and 9). For example, in the coating connecting body 23, a terminal of the electric wire 10 is inserted from an opening 23*c* (FIG. 1) between free ends $\mathbf{23}b_1$, $\mathbf{23}b_1$ of the respective barrel pieces 23*b*, 23*b*, and the coating 12 is placed on an inner wall (bottom surface) of the bottom 23*a*. This coating connecting body 23, for example, is wrapped around the coating 12 of the terminal of the electric wire 10 while the barrel pieces 23*b*, 23*b* are pressurized and deformed.

As described above, the terminal fitting 20 of the present embodiment can suppress the increase in the electrical resistance with the core wire 11, thereby improving the stability of the electrical connection with the core wire 11. And since the electric wire 1 with terminals includes this terminal fitting 20, the same effects as those produced by this terminal fitting 20 can be obtained.

For the terminal fitting according to the present invention, when a plurality of electric wires 10 are connected, the lengths of the respective press contact ends 24*a*, 24*a* of the pairs of press contact bodies 24, 24 may increase in accordance with the number of electric wires 10 to be connected, for example, and the electric wires 10 may be connected to the pairs of press contact bodies 24, 24. In the terminal fitting according to the present invention, when a plurality of the electric wires 10 are connected, a plurality of the pairs of press contact bodies 24, 24 may be provided to each of the electric wires 10, for example.

In the terminal fitting according to the present embodiment, the core wire connecting body allows a pair of press contact bodies at a farthest section to make press contact with strands of an outermost layer of the core wire or strands on an inner side of the strands of the outermost layer of the core wire. The core wire connecting body allows a pair of press contact bodies that are closer to an end part of the electric wire than the pair of press contact bodies at the farthest section are to make press contact with strands on the inner side of the strands with which the pair of press contact bodies at the farthest section make press contact. Therefore, this terminal fitting comes into contact with more strands than the conventional terminal fittings do, thereby increasing a contact area with the core wire, and thus suppressing increase in the electrical resistance between the terminal fitting and the core wire.

In an electric wire, when each of the strands thereof is molded of aluminum or an aluminum alloy, an oxide film is formed on a surface of the strand. However, the pair of press contact bodies scratch the surfaces of the strands to scrape off the oxide films from of the strands while the electric wire is pushed in. Thus, the terminal fitting allows the pair of press contact bodies at the farthest section to come into contact with the strands of the outermost layer of the core wire or the strands on the inner side of the strands of the outermost layer of the core wire without the oxide films interposed therebetween, and allows the pair of press contact bodies on the end part side with respect to the pair of press contact bodies at the farthest section to come into contact with the strands on the inner side of the strands with which the pair of press contact bodies at the farthest section make press contact without the oxide films interposed therebetween. Therefore, this terminal fitting, even when the strands are molded of aluminum or an aluminum alloy, can suppress the increase in the electrical resistance between the core wire and the terminal fitting.

Thus, the terminal fitting according to the present embodiment can suppress the increase in the electrical resistance between the terminal fitting and the core wire, thereby improving the stability of the electrical connection between the terminal fitting and the core wire. The electric wire with terminals according to the present embodiment includes this terminal fitting, thereby obtaining the same effect as that of this terminal fitting exerts.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal fitting comprising:

a core wire connecting body that is to be physically and electrically connected to a core wire of an electric wire in which the core wire including a plurality of strands is covered with a coating, wherein the core wire connecting body includes:

a bottom;

a pair of cantilevered side walls that stand up from the bottom and are disposed facing each other with a space therebetween; and a plurality of pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section make press contact with the strands of an outermost layer of the core wire, and the pair of press contact bodies that are closer to the end part of the electric wire than the pair of press contact bodies at the farthest section are, cut at least the strands of the outermost layer among the strands, and make press contact with the strands on an inner side of the strands of the outermost layer.

2. The terminal fitting according to claim 1, wherein among a plurality of pairs of the press contact bodies, a pair of press contact bodies closer to the end part of the electric wire have a smaller distance between the press contact bodies, and the pair makes press contact with the strands on the more inner side of the core wire.

3. The terminal fitting according to claim 1, further comprising:

a locking body that is disposed facing an end face of the end part of the electric wire, and is capable of locking the cut strands while retaining the cut strands on the inner side of the coating.

4. The terminal fitting according to claim 2, further comprising:

a locking body that is disposed facing an end face of the end part of the electric wire, and is capable of locking the cut strands while retaining the cut strands on the inner side of the coating.

5. A terminal fitting comprising:

a core wire connecting body that is to be physically and electrically connected to a core wire of an electric wire in which the core wire including a plurality of strands is covered with a coating, wherein the core wire connecting body includes:

a bottom;

a pair of cantilevered side walls that stand up from the bottom and are disposed facing each other with a space therebetween; and at least two pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the at least two pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section cut part of at least the strands of an outermost layer of the core wire and make press contact with the strands on an inner side of the cut strands, the pairs of press contact bodies on the end part side of the electric wire with respect to the pair of press contact bodies at the farthest section make press contact with the strands on the inner side of the strands with which the pair of press contact body at the farthest section make press contact, cut the strands on an outer side of the strands to be subjected to press contact, and make press contact with the strands that are on the more inner side when a distance between the pair of the press contact bodies is smaller.

6. The terminal fitting according to claim 5, wherein among a plurality of pairs of the press contact bodies, a pair of press contact bodies closer to the end part of the electric wire have a smaller distance between the press contact bodies, and the pair makes press contact with the strands on the more inner side of the core wire.

7. The terminal fitting according to claim 5, further comprising:

a locking body that is disposed facing an end face of the end part of the electric wire, and is capable of locking the cut strands while retaining the cut strands on the inner side of the coating.

8. The terminal fitting according to claim 6, further comprising:

a locking body that is disposed facing an end face of the end part of the electric wire, and is capable of locking the cut strands while retaining the cut strands on the inner side of the coating.

9. An electric wire with terminals comprising:

an electric wire in which a core wire including a plurality of strands is covered with a coating; and a terminal fitting that is assembled to the electric wire, wherein the terminal fitting includes a core wire connecting body that is to be physically and electrically connected to the core wire, the core wire connecting body includes:

a bottom;

a pair of cantilevered side walls that stand up from the bottom and are disposed facing each other with a space therebetween; and a plurality of pairs of press contact bodies, the press contact bodies in each pair being disposed facing each other with a space between the pair of side walls, and being configured to cut the coating of the electric wire inserted from an opening between respective free ends of the pair of side walls, and to make press contact with the strands of the core wire, the pairs of press contact bodies are disposed with a space between the pairs in an axial direction of the electric wire that is assembled to the core wire connecting body, and compared to a distance between the press contact bodies that is a pair at a farthest section that is farthest from an end part of the electric wire, a distance between the press contact bodies that is a pair closer to the end part of the electric wire than the pair at the farthest section is, is smaller, the pair of press contact bodies at the farthest section make press contact with the strands of the outermost layer of the core wire, and the pair of press contact bodies that are closer to the end part of the electric wire than the pair of press contact bodies at the farthest section are, cut at least the strands of an outermost layer among the strands, and make press contact with the strands on an inner side of the strands of the outermost layer.

* * * * *